US006060444A

United States Patent [19]

Schulz et al.

[11] Patent Number: 6,060,444

[45] Date of Patent: May 9, 2000

[54] METHOD OF MAKING NON-CAUSTIC SOLID CLEANING COMPOSITIONS

[75] Inventors: Rhonda Kay Schulz, Eagan; Helmut K. Maier, Golden Valley, both of Minn.

[73] Assignee: Ecolab Inc., St. Paul, Minn.

[21] Appl. No.: 08/874,443

[22] Filed: Jun. 16, 1997

Related U.S. Application Data

[63] Continuation of application No. 08/441,252, May 15, 1995, abandoned, which is a continuation of application No. 08/175,626, Dec. 30, 1993, abandoned.

[51] Int. Cl.[7] ..... C11D 11/00; C11D 3/10; C11D 3/20

[52] U.S. Cl. ..... 510/451; 510/108; 510/224; 510/233; 510/294; 510/298; 510/421; 510/440; 510/445; 510/447; 510/514

[58] Field of Search ..... 510/108, 224, 510/233, 294, 298, 440, 445, 447, 451, 421, 514

[56] References Cited

U.S. PATENT DOCUMENTS

| | | | |
|---|---|---|---|
| Re. 32,763 | 10/1988 | Fernholz et al. | 252/90 |
| Re. 32,818 | 1/1989 | Fernholz et al. | 252/90 |
| 2,382,163 | 8/1945 | MacMahon | 510/445 |
| 2,559,583 | 7/1951 | Barker | 252/152 |
| 2,559,584 | 7/1951 | Barker | 252/152 |
| 2,584,056 | 1/1952 | Soule et al. | 252/106 |
| 2,584,057 | 1/1952 | Soule et al. | 252/106 |
| 2,665,256 | 1/1954 | Barker | 252/152 |
| 2,824,091 | 2/1958 | Desty et al. | 260/96.5 |
| 2,927,900 | 3/1960 | Shiraeff | 252/152 |
| 3,046,232 | 7/1962 | Bonewitz | 252/156 |
| 3,324,038 | 6/1967 | Chaffee | 252/152 |
| 3,366,571 | 1/1968 | Cooper et al. | 252/99 |
| 3,390,093 | 6/1968 | Feierstein et al. | 252/138 |
| 3,554,915 | 1/1971 | Keay et al. | 252/99 |
| 3,639,286 | 2/1972 | Ballestra et al. | 252/109 |
| 3,741,913 | 6/1973 | Waag | 252/544 |
| 3,803,285 | 4/1974 | Jensen | 264/143 |
| 3,858,854 | 1/1975 | Win et al. | 252/89 |
| 3,894,466 | 7/1975 | Wibrow | 85/10 F |
| 3,920,586 | 11/1975 | Bonaparte et al. | 252/531 |
| 3,957,661 | 5/1976 | Verite | 252/89 |
| 4,119,578 | 10/1978 | Daeninckx et al. | 252/548 |
| 4,219,435 | 8/1980 | Biard et al. | 252/90 |
| 4,219,436 | 8/1980 | Gromer et al. | 252/135 |
| 4,242,217 | 12/1980 | Westermann et al. | 510/447 |
| 4,289,525 | 9/1981 | Pasarela et al. | 71/92 |
| 4,427,558 | 1/1984 | David | 252/8.8 |
| 4,541,831 | 9/1985 | Gunther et al. | 8/648 |
| 4,587,029 | 5/1986 | Brooks | 252/91 |
| 4,587,031 | 5/1986 | Kruse et al. | 252/135 |
| 4,595,520 | 6/1986 | Heile et al. | 252/160 |
| 4,601,844 | 7/1986 | Cilley | 252/95 |
| 4,615,819 | 10/1986 | Leng et al. | 252/110 |
| 4,624,713 | 11/1986 | Morganson et al. | 134/25.2 |
| 4,680,134 | 7/1987 | Heile et al. | 252/160 |
| 4,695,284 | 9/1987 | Hight | 8/137 |
| 4,722,802 | 2/1988 | Hutchings et al. | 252/174 |
| 4,725,376 | 2/1988 | Copeland | 252/90 |
| 4,731,223 | 3/1988 | Forestier et al. | 422/37 |
| 4,753,755 | 6/1988 | Gansser | 252/527 |
| 4,798,724 | 1/1989 | Khanna | 424/480 |
| 4,820,449 | 4/1989 | Menke et al. | 252/544 |
| 4,846,989 | 7/1989 | Killa | 252/99 |
| 4,861,518 | 8/1989 | Morganson et al. | 252/548 |
| 4,911,858 | 3/1990 | Bunczk et al. | 510/447 |
| 4,915,865 | 4/1990 | Westermann et al. | 510/224 |
| 4,919,828 | 4/1990 | Tiddetts et al. | 252/117 |
| 4,933,100 | 6/1990 | Ramachandran | 252/95 |
| 5,019,346 | 5/1991 | Richter et al. | 422/28 |
| 5,030,376 | 7/1991 | Lee et al. | 252/108 |
| 5,034,147 | 7/1991 | Ramachandran | 252/95 |
| 5,061,392 | 10/1991 | Bruegge et al. | 252/135 |
| 5,064,554 | 11/1991 | Jacobs et al. | 252/99 |
| 5,066,425 | 11/1991 | Ofosu-Asante et al. | 252/546 |
| 5,198,198 | 3/1993 | Gladfelter et al. | 422/264 |
| 5,234,615 | 8/1993 | Gladfelter et al. | 252/90 |
| 5,316,688 | 5/1994 | Gladfelter | 510/224 |
| 5,382,377 | 1/1995 | Raehse et al. | 510/445 |
| 5,397,506 | 3/1995 | Groth et al. | 252/547 |
| 5,674,831 | 10/1997 | Schulz et al. | 510/501 |
| 5,698,513 | 12/1997 | Schulz et al. | 510/501 |

FOREIGN PATENT DOCUMENTS

| | | | |
|---|---|---|---|
| 0 234 082 | 9/1987 | European Pat. Off. . | |
| 0 266 200 | 5/1988 | European Pat. Off. . | |
| 0 281 028 | 9/1988 | European Pat. Off. . | |
| 0 312 278 | 4/1989 | European Pat. Off. . | |
| 2501142 | 7/1975 | Germany | 252/174.16 |
| 63-168500 | 7/1988 | Japan . | |
| 1031831 | 6/1966 | United Kingdom . | |
| 93 07245 | 4/1993 | WIPO . | |

*Primary Examiner*—Lorna M. Douyon
*Attorney, Agent, or Firm*—Merchant & Gould P.C.

[57] ABSTRACT

A process for preparing a homogeneous, solid cleaning composition that comprises a cleaning agent, and optionally an additive agent and a hardening agent. The compositions are processed in a continuous mixing system at high shear, at or below the melting temperature of the ingredients. Preferably, the ingredients are processed in an extruder, and the mixture is extruded directly into a mold or other packaging system for dispensing the cleaning composition. The consistency of the composition ranges from that of a fused block solid to a malleable article. The cleaning compositions are useful for warewashing and cleaning hard surfaces, rinsing, sanitizing, deodorizing, laundry detergents, conveyor lubricants, and the like.

20 Claims, No Drawings

METHOD OF MAKING NON-CAUSTIC SOLID CLEANING COMPOSITIONS

This is a Continuation of application Ser. No. 08/441,252, filed May 15, 1995 now abandoned, which is a continuation application of U.S. Ser. No. 08/175,626, filed Dec. 30, 1993 (now abandoned).

FIELD OF THE INVENTION

The invention is directed to a process for manufacturing homogeneous, non-caustic, solid cleaning compositions, as for example, ware and/or hard surface cleaning compositions, rinse aids, sanitizing additives, laundry detergents and conveyor lubricants, that include a cleaning agent, additive agents such as detergent adjuvants as desired, and optionally a hardening agent such as polyethylene glycol (PEG). The cleaning compositions are preferably prepared in a continuous mixing system, most preferably an extruder.

BACKGROUND OF THE INVENTION

The development of solid block cleaning compositions has revolutionized the manner in which detergent compositions are dispensed by commercial and institutional entities that routinely use large quantities of cleaning materials. Solid block compositions offer unique advantages over the conventional liquids, granules or pellet forms of detergents, including improved handling, enhanced safety, elimination of component segregation during transportation and storage, and increased concentrations of active components within the composition. Because of these benefits, solid block cleaning compositions, such as those disclosed in U.S. Pat. Nos. RE 32,763, RE 32,818, 4,680,134 and 4,595,520, have quickly replaced the conventional composition forms in commercial and institutional markets.

Various hardening mechanisms have been used in cleaning and sanitizing compositions for converting a fluid composition to a solid mass for containment and modification of the solubility of the active ingredients during use. For example, the active ingredients may be combined with the hardening agent under melting temperatures, commonly referred to as a "molten process," to achieve a homogeneous mixture, and the melt then poured into a mold and cooled to a solid form. Solid alkaline detergent compositions may also be prepared from an aqueous emulsion of detergent ingredients combined with a solidifying agent that can hydrate to bind free water in the emulsion which, optionally after heating and cooling, hardens to a solid.

U.S. Pat. No. 5,019,346 to Richter, for example, discloses a solid block drain treatment product formed by heating a mixture containing a chemical sanitizer and a hardening agent such as urea or an alkyl amide such as stearic monoethanolamide or stearic diethanolamide, and decanting the melt into containers. U.S. Pat. No. 4,861,518 to Morganson discloses a solid cleaning concentrate formed by heating an anionic or nonionic surfactant system with a hardening agent such as polyethylene glycol, at about 130–150° F. to form a melt. The melt is combined with other ingredients including a solubilizer and an alkali, to form a homogeneous mixture, and the molten mixture then poured into a capsule container to cure or harden. U.S. Pat. Nos. 4,595,520 and 4,680,134 to Heile et al. disclose a solid alkaline detergent formed from an aqueous emulsion containing a sodium condensed phosphate hardness sequestering agent and an alkaline builder salt such as sodium hydroxide, which is solidified by incorporating a hydratable hardening agent such as an anhydrous sodium carbonate and/or sodium sulfate. Preferably, the emulsion is heated to form a molten mass, and then cooled to effect solidification. U.S. Pat. No. 5,064,554 to Jacobs et al. discloses a solid detergent in the form of a fused block manufactured by preparing a melt of alkali metal silicate, alkali metal hydroxide, optionally water, an active chlorine donor and/or an organic complexing agent, combining the melt with a penta-alkali metal triphosphate, introducing the melt into a flow mixer, and pouring the molten mixture into a mold to solidify.

Solid block cleaning and sanitizing compositions and rinse aids provide a significant improvement over the conventional liquid, granular and pelletized cleaning compositions. Although the molten process is useful for preparing solid block compositions, time and expense would be saved if heating and cooling of the composition could be minimized or eliminated from the process, and higher viscosities could be used. Also, lower process temperatures would better facilitate the use of heat-sensitive ingredients in cleaning compositions. In addition, less sturdy packaging would be required if the processed mixture could be dispensed at a lower temperature. Furthermore, eliminating molten temperatures would avoid swelling and deformation of the solid product.

Various attempts have been made to manufacture cleaning compositions by an extrusion process. U.S. Pat. No. 5,061,392 to Bruegge et al., for example, discloses a method of forming a detergent composition having a paste-like consistency, by combining a first aqueous solution containing a potassium tripolyphosphate and a second aqueous solution containing a water-soluble, sodium-based detergent builder, namely sodium hydroxide. Upon mixing, the viscosity of the mixture rapidly increases to form a highly viscous paste. In another extrusion method, as disclosed in U.S. Pat. No. 4,933,100 to Ramachandran, an organic detergent of particulate or patty form is formed by kneading together a synthetic organic detergent, a hydratable builder salt such as sodium tripolyphosphate, and water. The mixture is passed through an extruder and forced through openings at or slightly above room temperature and a low pressure to form a rod-shaped extrudate. A disadvantage of these processes is that a caustic, hydratable alkaline source is required to facilitate hardening of the processed composition after extrusion.

Therefore, an object of the invention is to provide a process for manufacturing a solid, non-caustic cleaning composition at a process temperature below the melt temperature of the ingredients. Another object is to provide a process for making a cleaning composition at low processing temperatures and high viscosities to achieve more rapid solidification of the cast or extruded composition. A further object is to provide a process that will substantially eliminate swelling of the solid cast or extruded composition and product. Yet another object is to provide a method for making a cleaning composition that includes a hardening agent, whereby the proportion of hardening agent in the composition is substantially reduced, and the amount of active ingredients is substantially increased, relative to the corresponding cleaning composition made by other processing techniques known and used in the art.

SUMMARY OF THE INVENTION

The invention is directed to a process for preparing a homogeneous, non-caustic, solid cleaning composition comprising a cleaning agent, detergent adjuvants and additives as desired, and optionally a hardening agent, in which no or minimal heat is applied from an external source. Cleaning compositions that may be produced according to the present method include a wide variety of cleaning compositions for use, for example, in warewashing and cleaning hard surfaces, rinsing, sanitizing, deodorizing, and the like.

The process of the invention includes the steps of (a) mixing an effective amount of a cleaning agent in a continuous mixing system at high shear, at or below the melting temperature of the cleaning agent, to form a substantially homogeneous fluid mixture; (b) discharging the mixture from the mixing system; and (c) allowing the mixture to harden to a solid composition.

The invention provides a method of manufacturing a homogeneous, cleaning composition at a substantially lower temperature and a substantially higher viscosity than other methods such as the "molten process" in which the ingredients are melted together to achieve a homogenous mixture. It is preferred that the processing temperature is at or below the melting temperatures of the ingredients, and the viscosity of the mixture is maintained at about 1,000–1,000,000 cps. Optionally, external heat may be applied to the mixture up to a temperature of about 150° C. to facilitate processing, for example, during the mixing phase to decrease viscosity of the mixture, during the extruding step, and the like. Advantageously, where a hardening agent is used, the invention provides a process for making a cleaning composition containing a substantially lower amount of the hardening agent and higher amounts of the cleaning agent and other active ingredients than corresponding compositions prepared according to a molten process.

The ingredients are processed in a continuous processing system capable of mixing the ingredients at high shear to provide a homogeneous mixture, and of retarding solidification and maintaining the composition as a flowable mass during processing. Continuous processing systems useful according to the invention include, for example, a continuous flow mixer, or preferably a single-or twin-screw extruder, with a twin-screw extruder being highly preferred.

A variety of cleaning compositions may be produced according to the present method. The types and amounts of ingredients that comprise a particular composition will vary according to its purpose and use, as for example, a laundry detergent, a conveyor lubricant, a composition for cleaning hard surfaces, rinsing, sanitizing, deodorizing, and the like. The processed composition will comprise an effective cleaning amount of one or more cleaning agents, one or more detergent adjuvants and/or other additives as desired, and optionally, a minor but effective amount of a hardening agent for example, polyethylene glycol, stearic monoethanolamide, a hydratable solidifying agent, and the like. Suitable additive agents include a detergent adjuvant or filler, as for example, an alkaline source, a sequestering agent, a soil suspending agent, a bleaching agent, a secondary hardening agent, a solubility modifying agent, and other like agents. The ingredients may be added in the form of a solid such as a dry particulate or as a liquid. An ingredient may be added to the mixture separately or as part of a premix with other ingredient(s). One or more premixes may be used, and may include part or all of an ingredient.

After processing, the mixture is discharged from the mixing system, as for example, by casting or extruding, and the composition is allowed to harden to a solid form. Advantageously, due to the "cold processing" of the ingredients, the mixture may be cast or extruded directly into a packaging wrapper or casing, or into a mold that may also serve as a dispenser for the composition during use. Preferably, the mixture is discharged from the mixer at or near ambient temperature, preferably about 30–50° C. Preferably, the processed composition "sets up" to a solid form within about 1 minute to about 3 hours, preferably within about 5 minutes to about 1 hour, of being discharged from the mixer. Preferably, complete solidification or equilibrium of the processed composition is within about 1–48 hours of being discharged from the mixer, preferably within about 1–36 hours, preferably within about 1–24 hours. Solidification of the composition is substantially simultaneous throughout its mass, and without significant post-solidification swelling.

By the term "solid" as used to describe the processed composition, it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid cast composition may range from that of a fused block solid which is relatively dense and hard, similar to concrete, to a consistency which may be characterized as malleable and sponge-like, similar to a caulking material.

Advantageously, with the present method, a homogeneous, solid cleaning composition may be processed at a temperature lower than that typically used in other methods which require melting of the ingredients to form a solid composition. Since high melt temperatures are not required, problems with de-activation of thermally-sensitive ingredients in the composition may be avoided. In addition, due to the lower temperatures used in the processing, little or no cooling of the mixture is required prior to being cast or extruded, for example, into a packaging wrapper, casing, mold, dispenser, and the like. The use of lower temperatures also broadens the options of packaging materials that may be used to contain the processed composition.

In addition, hardening of the cleaning composition after processing is accelerated since the end-process temperature of the composition is closer to that required for solidification. The rapid solidification achieved by the present method speeds production of the solid product, and minimizes segregation of the ingredients of the composition, for example by trapping non-compatible ingredients in a matrix of suitably high viscosity and a low temperature to prevent separation. Also, the use of an extruder or similar device provides, for example, continuous processing of a cleaning composition, easy clean-up, and a high level of control and repeatability of the formulation process. Further, a multi-chamber extruder provides segregation of chambers for sequential processing of the cleaning composition.

DETAILED DESCRIPTION OF THE INVENTION

The present invention provides a process for manufacturing a variety of solid, non-caustic, cleaning compositions. The method of the invention uses high shear mixing, and no or a reduced amount of a hardening agent and lower processing temperatures compared to other known methods for making the cleaning composition by melting the ingredients to achieve a homogeneous mixture. Cleaning compositions which may be prepared according to the method of the invention include, for example, detergent compositions, ware and/or hard surface cleaning compositions, rinse aids, sanitizing additives, deodorant blocks, laundry products, conveyor lubricants, and other like compositions.

The compositions are produced using a continuous mixing system, preferably a single- or twin-screw extruder, by combining and mixing one or more cleaning agents at high shear to form a homogeneous mixture. Preferably, the processing temperature is at or below the melting temperature of the ingredients. Optionally, but preferably, the cleaning agent is combined with one or more additive ingredients, and optionally a hardening agent. The processed mixture may be dispensed from the mixer by extruding, casting or other suitable means, whereupon the composition hardens to a solid form which ranges in consistency from a solid block to a malleable, spongy, self-supporting form, such as a coil, square or other shape. Variations in processing parameters may be used to control the development of crystal size and crystalline structure of the matrix and thus the texture of the final product. For example, continuing to shear the mixture while solidification is in progress will create a smaller crystal and a pasty product. The structure of the matrix may be characterized according to its hardness, melting point, material distribution, crystal structure, and other like properties according to known methods in the art. A cleaning composition processed according to the method of the invention is substantially homogeneous with regard to the distribution of ingredients throughout its mass, and also substantially deformation-free.

The cleaning compositions of the invention comprise conventional active ingredients that will vary in type and amount according to the particular composition being manufactured. For example, a detergent composition for removing soils and stains may include a major amount of a surfactant or surfactant system, as for example, a nonionic surfactant such as a nonylphenol ethoxylate or a polyethylene glycol fatty alcohol ether, a minor but effective amount of a hardening agent such as a solid polyethylene glycol compound, and minor but effective amounts of other ingredients such as a chelating agent/sequestrant such as ethylenediaminetetraacetic acid (EDTA) or sodium tripolyphosphate, an alkaline source such as a metal silicate, a secondary hardening agent such as urea, a soil suspending agent such as carboxymethylcellulose, a bleaching agent such as an active chlorine or active oxygen releasing agent, an enzyme such as a proteinase or an amylase, and the like.

Unless otherwise specified, the term "wt-%" is the weight of an ingredient based upon the total weight of the composition.

Cleaning Agents

The composition comprises at least one cleaning agent which is preferably a surfactant or surfactant alkaline source system. A variety of surfactants can be used in a cleaning composition, including anionic, nonionic, cationic and zwitterionic surfactants, which are commercially available from a number of sources. For a discussion of surfactants, see Kirk-Othmer, *Encyclopedia of Chemical Technology*, Third Edition, volume 8, pages 900–912. Preferably, the composition comprises a cleaning agent in an amount effective to provide a desired level of soil removal and cleaning, preferably about 30–95 wt-%, more preferably about 50–85 wt-%.

Anionic surfactants useful in the present polyethylene glycol-based cleaning compositions include, for example, carboxylates such as alkylcarboxylates and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Preferred anionics are sodium alkylarylsulfonate, alpha-olefinsulfonate, fatty alcohol sulfates, and the like.

Nonionic surfactants useful in cleaning compositions, include those having a polyalkylene oxide polymer as a portion of the surfactant molecule. Such nonionic surfactants include, for example, alcohol alkoxylates such as alcohol ethoxylate propoxylates, alcohol propoxylates, alcohol propoxylate ethyoxylate propoxylates, alcohol ethoxylate butoxylates, and the like, and alkyl-capped alcohol alkoxylates; polyoxyethylene glycol ethers of fatty alcohols such as Ceteareth-27 or Pareth 25-7, and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC™ (BASF-Wyandotte), and the like; and other like nonionic compounds.

Cationic surfactants useful for inclusion in a cleaning composition for sanitizing or fabric softening, include amines such as primary, secondary and tertiary monoamines with $C_{18}$ alkyl or alkenyl chains, ethoxylated alkylamines, alkoxylates of ethylenediamine, an imidazole such as a 2-alkyl-1-(2-hydroxyethyl)-2-imidazolines, a 1-(2-hydroxyethyl)-2-imidazolines, and the like; and quaternary ammonium salts, as for example, quaternary ammonium chloride surfactants such as n-alkyl($C_{12}$–$C_{18}$) dimethylbenzyl ammonium chloride, n-tetradecyldimethylbenzylammonium chloride monohydrate, a napthylene-substituted quaternary ammonium chloride such as dimethyl-1-napthylmethylammonium chloride, and the like; and other like surfactants.

Also useful are zwitterionic surfactants such as β-N-alkylaminopropionic acids, N-Alkyl-β-iminodipropionic acids, imidazoline carboxylates, N-alkylbetaines, sultaines, and the like.

Aqueous Medium

The ingredients of the composition may be processed in a minor but effective amount of an aqueous medium such as water, to provide an effective level of viscosity for processing the mixture, and to provide the processed composition with the desired amount of firmness and cohesion during discharge and upon hardening. The mixture during processing may include about 0.01–15 wt-% of an aqueous medium, preferably about 0.1–10 wt-%. The composition upon being discharged from the mixer may contain about 0.01–15 wt-% of an aqueous medium, preferably about 0.1–5 wt-%.

Hardening Agent

A hardening agent, as used in the present method and compositions, is a compound or system of compounds, organic or inorganic, that significantly contributes to the uniform solidification of the composition. Preferably, the hardening agent is compatible with the cleaning agent and other active ingredients of the composition, and is capable of providing an effective amount of hardness and/or aqueous solubility to the processed composition. The hardening agent should also be capable of forming a homogeneous matrix with the cleaning agent and other ingredients when mixed and solidified to provide a uniform dissolution of the cleaning agent from the solid composition during use.

The amount of hardening agent included in the cleaning composition will vary according to the type of cleaning composition being prepared, the ingredients of the composition, the intended use of the composition, the quantity of dispensing solution applied to the solid composition over time during use, the temperature of the dispensing solution, the hardness of the dispensing solution, the physical size of the solid composition, the concentration of the other ingredients, the concentration of the cleaning agent in the composition, and other like factors. It is preferred that the amount of the hardening agent is effective to combine with the cleaning agent and other ingredients of the composition to form a homogeneous mixture under continuous mixing conditions and a temperature at or below the melting temperature of the hardening agent.

It is also preferred that the hardening agent will form a matrix with the cleaning agent and other ingredients which will harden to a solid form under ambient temperatures of about 30–50° C., preferably about 35–45° C., after mixing ceases and the mixture is dispensed from the mixing system, within about 1 minute to about 3 hours, preferably about 2 minutes to about 2 hours, preferably about 5 minutes to about 1 hour. A minimal amount of heat from an external source may be applied to the mixture to facilitate processing of the mixture. It is preferred that the amount of the hardening agent included in the composition is effective to provide a hardness and desired rate of controlled solubility of the processed composition when placed in an aqueous medium to achieve a desired rate of dispensing the cleaning agent from the solidified composition during use. Preferably, the hardening agent is present in an amount of about 0.01–20 wt-%, preferably about 0.05–5 wt-%, preferably about 0.1–3 wt-%.

The hardening agent may be, for example, an amide such as stearic monoethanolamide, lauric diethanolamide, and stearic diethanolamide, available commercially from Stepan Chemical under the trademark NINOL™, and from Scher Chemical Company under the trademark SCHERCOMID™. Alkyl amides particularly provide varying degrees of hardness and solubility when combined with cationizing surfactants. Generally, the $C_{16}$ to $C_{18}$ straight chain aliphatic alkyl amides provide a higher degree of insolubility with a higher degree of hardness. For a further discussion of alkyl amide hardening agents, see U.S. Pat. No. 5,019,346 to Richter, the disclosure of which is incorporated by reference herein.

Another preferred hardening agent is a polyethylene glycol (PEG) or propylene glycol compound for use in a cleaning composition comprising a nonionic surfactant cleaning agent, such as a nonyl phenol ethoxylate, a linear alkyl alcohol ethoxylate, an ethylene oxide/propylene oxide block copolymers such as the surfactants available commercially under the trademark PLURONIC™ from BASF-Wyandotte. The solidification rate of cleaning compositions comprising a polyethylene glycol hardening agent made according to the invention will vary, at least in part, according to the amount and the molecular weight of the polyethylene glycol added to the composition.

Polyethylene glycol compounds useful according to the invention include, for example, solid polyethylene glycols of the general formula $H(OCH_2—CH_2)_nOH$, where n is greater than 15, more preferably about 30–1700. Solid polyethylene glycols which are useful are marketed under the trademark Carbowax™, and are commercially available from Union Carbide. Preferably, the polyethylene glycol is a solid in the form of a free-flowing powder or flakes, having a molecular weight of about 1000–100,000, preferably about 3000–8000. Suitable polyethylene glycol compounds useful according to the invention include, for example, PEG 900, PEG 1000, PEG 1500, PEG 4000, PEG 6000, PEG 8000 among others, with PEG 8000 being preferred.

The hardening agent may also be a hydratable substance such as an anhydrous sodium carbonate, anhydrous sodium sulfate, or combination thereof. Preferably, the hydratable hardening agent is used in an alkaline cleaning composition which includes ingredients such as a condensed phosphate hardness sequestering agent and an alkaline builder salt, wherein the amount of caustic builders is about 5–15 wt-%, as disclosed, for example, in U.S. Pat. Nos. 4,595,520 and 4,680,134 to Heile et al., the disclosures of which are incorporated by reference herein. A hydratable hardening agent, according to the invention, is capable of hydrating to bind free water present in a liquid detergent emulsion to the extent that the liquid emulsion becomes hardened or solidified to a homogenous solid. The amount of a hydratable substance included in a detergent composition processed according to the invention, will vary according to the percentage of water present in the liquid emulsion as well as the hydration capacity of the other ingredients. Preferably, the composition will comprise about 10–60 wt-% of a hydratable hardening agent, preferably about 20–40 wt-%.

Other hardening agents that may be used in a cleaning composition processed according to the invention include, for example, urea, also known as carbamide, starches that have been made water-soluble through an acid or alkaline treatment process, and various inorganics that impart solidifying properties to a heated liquid matrix upon cooling.

Advantageously, a cleaning composition processed according to the invention may comprise an amount of hardening agent which is about 50–85% lower than that included in a corresponding composition comprising substantially the same ingredients but prepared by another method such as a "molten process" known in the art. For example, where polyethylene glycol-based cleaning compositions would typically comprise about 10—30 wt-% polyethylene glycol hardening agent when made according to another method practiced in the art, a corresponding cleaning composition made according to the present process will comprise a reduced amount of the hardening agent, or about 3–15 wt-% polyethylene glycol, preferably about 5–8 wt-%, preferably about 2–6 wt-%, preferably about 5–6 wt-%.

Additive Agents

The cleaning compositions may further include conventional detergent adjuvants such as a sequestering agent, bleaching agent, alkaline source, enzyme, secondary hardening agent, detergent filler, defoamer, anti-redeposition agent, a threshold agent or system, aesthetic enhancing agent (i.e., dye, perfume), and other like additives. Adjuvants and other additive ingredients will vary according to the type of composition being manufactured.

Chelating/Sequestering Agents

The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. Depending on the type of cleaning composition being formulated, a chelating/sequestering agent is included in an amount of about 0.1–70 wt-%, preferably from about 5–50 wt-%.

Useful aminocarboxylic acids include, for example, n-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like. Examples of condensed phosphates useful in the present composition include, for example, sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as aminotris(methylene phosphonic acid), hydroxyethylidene diphosphonic acid, ethylenediaminetetrae(methylene phosphonic acid), diethylenetriaminepente(methylene phosphonic acid), and the like. It is preferred to use a neutralized or alkaline phosphonate, or to combine the phosphonate with an alkali source prior to being added into the mixture such that there is little or no heat generated by a neutralization reaction when the phosphate is added.

Polyacrylates suitable for use as cleaning agents include, for example, polyacrylic acid, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, *Encyclopedia of Chemical Technology*, Third Edition, volume 5, pages 339–366 and volume 23, pages 319–320, the disclosure of which is incorporated by reference herein.

Bleaching Agents

Bleaching agents that may be used in a cleaning composition for lightening or whitening a substrate, include bleaching compounds capable of liberating an active halogen species, such as —Cl, —Br, —OCl and/or —OBr, under conditions typically encountered during the cleansing process. Suitable bleaching agents for use in the present cleaning compositions include, for example, chlorine-containing compounds such as a chlorine, hypochlorite, chloramine, and the like. Preferred halogen-releasing compounds include the alkali metal dichloroisocyanurates, chlorinated trisodium phosphate, the alkali metal hypochlorides, monochloramine and dichloramine, and the like. Encapsulated chlorine sources may also be used to enhance the stability of the chlorine source in the composition (see, for example, U.S. Pat. No. 4,618,914, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, preferably about 0.1–10 wt-%, preferably about 1–6 wt-%.

Alkaline Sources

The cleaning composition produced according to the invention may include minor but effective amounts of one or more alkaline sources to enhance cleaning of a substrate and improve soil removal performance of the composition. It can be appreciated that a caustic matrix has a tendency to solidify due to the activity of an alkaline source in fixing the free water present in a composition as water of hydration. Premature hardening of the composition may interfere with mixing of the active ingredients with the hardening agent to form a homogeneous mixture, and/or with casting or extrusion of the processed composition. Accordingly, an alkali metal hydroxide or other hydratable alkaline source, is preferably included in the cleaning composition in an amount effective to provide the desired level of cleaning action yet avoid premature solidification of the composition. However, it can be appreciated that an alkali metal hydroxide or other hydratable alkaline source can assist to a limited extent, in solidification of the composition. It is preferred that the composition comprises about 0.1–70 wt-% of a hydratable alkaline source, more preferably about 10–50 wt-%.

Suitable alkali metal hydroxides include, for example, sodium or potassium hydroxide. An alkali metal hydroxide may be added to the composition in the form of solid beads, dissolved in an aqueous solution, or a combination thereof. Alkali metal hydroxides are commercially available as a solid in the form of prilled beads having a mix of particle sizes ranging from about 12–100 U.S. mesh, or as an aqueous solution, as for example, as a 50 wt-% and a 73 wt-% solution. It is preferred that the alkali metal hydroxide is added in the form of an aqueous solution, preferably a 50 wt-% hydroxide solution, to reduce the amount of heat generated in the composition due to hydration of the solid alkali material.

A cleaning composition may comprise a secondary alkaline source other than an alkali metal hydroxide. Examples of secondary alkaline sources include a metal silicate such as sodium or potassium silicate or metasilicate, a metal carbonate such as sodium or potassium carbonate, bicarbonate or sesquicarbonate, and the like; a metal borate such as sodium or potassium borate, and the like; ethanolamines and amines; and other like alkaline sources. Secondary alkalinity agents are commonly available in either aqueous or powdered form, either of which is useful in formulating the present cleaning compositions. The composition may include a secondary alkaline source in an amount of about 1–30 wt-%, preferably about 10–20 wt-%.

Detergent Fillers

A cleaning composition may include a minor but effective amount of one or more of a detergent filler, which does not perform as a cleaning agent per se, but cooperates with the cleaning agent to enhance the overall cleaning action of the composition. Examples of fillers suitable for use in the present cleaning compositions include sodium sulfate, sodium chloride, starch, sugars, and $C_1$–$C_{10}$ alkylene glycols such as propylene glycol, and the like. Preferably, the filler is included in an amount of about 1–20 wt-%, preferably about 3–15 wt-%.

Defoaming Agents

A minor but effective amount of a defoaming agent for reducing the stability of foam may also be included in a cleaning composition. Preferably, the cleaning composition includes about 0.0001–5 wt-% of a defoaming agent, preferably about 0.01–1 wt-%.

Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found in U.S. Pat. No. 3,048,548 to Martin et al., U.S. Pat. No. 3,334,147 to Brunelle et al., and U.S. Pat. No. 3,442,242 to Rue et al., the disclosures of both references incorporated by reference herein.

Anti-redeposition Agents

A cleaning composition may also include an anti-redeposition agent capable of facilitating sustained suspension of soils in a cleaning solution and preventing removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, carboxymethyl cellulose, and the like. A cleaning composition may include about 0.5–10 wt-%, preferably about 1–5 wt-%, of an anti-redeposition agent.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical Co.), Fluorescein (Capitol Color and Chemical), Rhodamine (D&C Red No. 19), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Processing of the Composition

The invention provides a method of processing non-caustic cleaning compositions at lower temperatures and higher viscosities than are typically used when processing the same or similar composition by other methods such as a molten process.

Although not intended to limit the scope of the invention, it is believed that, at least in part, the continuous mixing of the ingredients of the cleaning composition at high shear enables the composition to be processed at a significantly lower temperature than that needed in other processing methods by which the ingredients of the composition are melted to form a homogeneous mixture. It is also believed that the continuous mixing of the ingredients enables the amount of the hardening agent required for effective hardening of a composition to be substantially reduced from that typically needed for preparing the corresponding cleaning compound by a molten process or other known method.

The mixing system provides for continuous mixing of the ingredients at high shear to form a substantially homogeneous liquid or semi-solid mixture in which the ingredients are distributed throughout the mass. The mixing system includes means for mixing the ingredients to provide shear effective for maintaining the mixture at a flowable consistency such that the mixture can be stirred, mixed, agitated, blended, poured, extruded, and/or molded in conventional industrial mixing and/or shearing equipment of the type suitable for continuous processing and uniform distribution of ingredients in a mixture. Preferably, the viscosity of the mixture during processing is about 1,000–1,000,000 cps, preferably about 5,000–200,000 cps. The mixing system is preferably a continuous flow mixer, as for example, a Teledyne continuous processor, a Beardsley Piper continuous mixer, more preferably a single- or twin-screw extruder, with a twin-screw extruder being highly preferred, as for example, a multiple section Buhler Miag twin-screw extruder.

It is preferred that the mixture is processed at a temperature lower than the melting temperature of the ingredients of the composition, preferably about 1–90° C. lower, preferably about 5–20° C. lower. Although minimal or no external heat may be applied to the mixture during processing, it can be appreciated that the temperature achieved by the mixture may become elevated during processing due to variances in processing conditions, and/or by an exothermic reaction between ingredients. Optionally, the temperature of the mixture may be increased, for example at the inlets or outlets of the mixing system, by applying heat from an external source to achieve a temperature of about 50–150° C., preferably about 55–70° C., to facilitate processing of the mixture.

In general, the composition is processed at a pressure of about 5–150 psig, preferably about 10–30 psig. The pressure may be increased up to about 30–6000 psig to maintain fluidity of the mixture during processing, to provide a force effective to urge the mixture through the mixer and discharge port, and the like.

An ingredient may be in the form of a liquid or solid such as a dry particulate, and may be added to the mixture separately or as part of a premix with one or more other ingredient, as for example, the cleaning agent, aqueous medium, and additional ingredients such as a second cleaning agent, a detergent adjuvant or other additive, a hardening agent, and the like. One or more premixes may be added to the mixture.

An aqueous medium may be included in the mixture as desired, in a minor but effective amount to maintain the mixture at a desired viscosity during processing, and to provide the processed composition and final product with the desired amount of firmness and cohesion during discharge and hardening. The aqueous medium may be included in the mixture as a separate ingredient, or as part of a liquid ingredient or premix.

The ingredients are mixed together at high shear to form a substantially homogenous consistency wherein the ingredients are distributed substantially evenly throughout the mass. The mixture is then discharged from the mixing system by casting into a mold or other container, by extruding the mixture, and the like. Preferably, the mixture is cast or extruded into a mold or other packaging system, that can optionally, but preferably, be used as a dispenser for the composition. It is preferred that the temperature of the mixture when discharged from the mixing system is sufficiently low to enable the mixture to be cast or extruded directly into a packaging system without first cooling the mixture. Preferably, the mixture at the point of discharge is at about ambient temperature, about 30–50° C., preferably about 35–45° C. The composition is then allowed to harden to a solid form that may range from a low density, sponge-like, malleable, caulky consistency to a high density, fused solid, concrete-like block.

In a preferred method according to the invention, the mixing system is a twin-screw extruder which houses two adjacent parallel rotating screws designed to co-rotate and intermesh, the extruder having multiple barrel sections and a discharge port through which the mixture is extruded. The extruder may include, for example, one or more feed or conveying sections for receiving and moving the ingredients, a compression section, mixing sections with varying temperature, pressure and shear, a die section, and the like. Suitable twin-screw extruders can be obtained commercially and include for example, Buhler Miag Model No. 62 mm, Buhler Miag, Plymouth, Minn. USA.

Extrusion conditions such as screw configuration, screw pitch, screw speed, temperature and pressure of the barrel sections, shear, throughput rate of the mixture, water content, die hole diameter, ingredient feed rate, and the like, may be varied as desired in a barrel section to achieve effective processing of ingredients to form a substantially homogeneous liquid or semi-solid mixture in which the ingredients are distributed evenly throughout. To facilitate processing of the mixture within the extruder, it is preferred that the viscosity of the mixture is maintained at about 1,000–1,000,000 cps, more preferably about 5,000–200,000 cps.

The extruder comprises a high shear screw configuration and screw conditions such as pitch, flight (forward or reverse) and speed effective to achieve high shear processing of the ingredients to a homogenous mixture. Preferably, the screw comprises a series of elements for conveying, mixing, kneading, compressing, discharging, and the like, arranged to mix the ingredients at high shear and convey the mixture through the extruder by the action of the screw within the barrel section. The screw element may be a conveyor-type screw, a paddle design, a metering screw, and the like. A preferred screw speed is about 20–250 rpm, preferably about 40–150 rpm.

Optionally, heating and cooling devices may be mounted adjacent the extruder to apply or remove heat in order to obtain a desired temperature profile in the extruder. For example, an external source of heat may be applied to one or more barrel sections of the extruder, such as the ingredient inlet section, the final outlet section, and the like, to increase fluidity of the mixture during processing through a section or from one section to another, or at the final barrel section through the discharge port. Preferably, the temperature of the mixture during processing including at the discharge port, is maintained at or below the melting temperature of the ingredients, preferably at about 50–200° C.

In the extruder, the action of the rotating screw or screws will mix the ingredients and force the mixture through the sections of the extruder with considerable pressure. Pressure may be increased up to about 6,000 psig, preferably up to about 5–150 psig, in one or more barrel sections to maintain the mixture at a desired viscosity level or at the die to facilitate discharge of the mixture from the extruder.

The flow rate of the mixture through the extruder will vary according to the type of machine used. In general, a flow rate is maintained to achieve a residence time of the mixture within the extruder effective to provide substantially complete mixing of the ingredients to a homogenous mixture, and to maintain the mixture at a fluid consistency effective for continuous mixing and eventual extrusion from the mixture without premature hardening.

When processing of the ingredients is complete, the mixture may be discharged from the extruder through the discharge port, preferably a die. The pressure may also be increased at the discharge port to facilitate extrusion of the mixture, to alter the appearance of the extrudate, for example, to expand it, to make it smoother or grainier in texture as desired, and the like.

The cast or extruded composition eventually hardens due, at least in part, to cooling and/or the chemical reaction of the ingredients. The solidification process may last from a few minutes to about 2–3 hours, depending, for example, on the size of the cast or extruded composition, the ingredients of the composition, the temperature of the composition, and other like factors. Preferably, the cast or extruded composition "sets up" or begins to harden to a solid form within about 1 minute to about 3 hours, preferably about 2 minutes to about 2 hours, preferably about 5 minutes to about 1 hour.

Packaging System

The processed compositions of the invention may be cast or extruded into temporary molds from which the solidified compositions may be removed and transferred for packaging. The compositions may also be cast or extruded directly into a packaging receptacle. Extruded material may also be cut to a desired size and packaged, or stored and packaged at a later time.

The packaging receptacle or container may be rigid or flexible, and composed of any material suitable for containing the compositions produced according to the invention, as for example, glass, steel, plastic, cardboard, cardboard composites, paper, and the like. A preferred receptacle is a container comprised of a polyolefin such as polyethylene.

Advantageously, since the composition is processed at or near ambient temperatures, the temperature of the processed mixture is low enough so that the mixture may be cast or extruded directly into the container or other packaging receptacle without structurally damaging the receptacle material. As a result, a wider variety of materials may be used to manufacture the container than those used for compositions that processed and dispensed under molten conditions.

It is highly preferred that the packaging used to contain the compositions is manufactured from a material which is biodegradable and/or water-soluble during use. Such packaging is useful for providing controlled release and dispensing of the contained cleaning composition. Biodegradable materials useful for packaging the compositions of the invention include, for example, water-soluble polymeric films comprising polyvinyl alcohol, as disclosed for example in U.S. Pat. No. 4,474,976 to Yang; U.S. Pat. No. 4,692,494 to Sonenstein; U.S. Pat. No. 4,608,187 to Chang; U.S. Pat. No. 4,416,793 to Haq; U.S. Pat. No. 4,348,293 to Clarke; U.S. Pat. No. 4,289,815 to Lee; and U.S. Pat. No. 3,695,989 to Albert, the disclosures of which are incorporated by reference herein.

In addition, the mixture may be cast into a variety of shapes and sizes by extrusion since the viscosity of the mixture can be varied, for example, according to the amount of shear applied during mixing, the amount of hardening agent and water in the composition ingredients, temperature of the mixture, and other like factors. Also, unlike the "molten process," since the mixture is processed at a relatively low temperature, minimal cooling of the composition is required prior to or after casting or extruding. The low temperature of the discharged material also enhances safety for those handling the material. In addition, the extruded or cast composition will harden substantially simultaneously throughout its mass when the mixture is discharged from the mixing system due to cooling and/or the chemical reaction of the ingredients of the composition, with or without a hardening agent.

Where the composition comprises a highly caustic material, safety measures should be taken during manufacture, storage, dispensing and packaging of the processed composition. In particular, steps should be taken to reduce the risk of direct contact between the operator and the solid cast composition, and the washing solution that comprises the composition.

Dispensing of the Processed Compositions

It is preferred that a cleaning composition made according to the present invention is dispensed from a spray-type dispenser such as that disclosed in U.S. Pat. Nos. 4,826,661, 4,690,305, 4,687,121, and 4,426,362, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use.

The invention will be further described by reference to the following detailed examples. These examples are not meant to limit the scope of the invention that has been set forth in the foregoing description. Variation within the concepts of the invention are apparent to those skilled in the art.

EXAMPLE 1

Cleaning composition containing a nonionic surfactant cleaning agent and a polyethylene glycol hardening agent A cleaning composition was prepared for use in textile care and laundering. The ingredients were processed in a Teledyne 2" model continuous twin-screw mixer. The dry premix was fed into the powder feeder port at the beginning of the Teledyne using a volumetric screw feeder. The liquid premix was fed into the first liquid feed port of the Teledyne using a pump. The Teledyne screw was configured for mixing and conveying.

The ingredients of the liquid premix were as follows:

| INGREDIENT | LIQUID PREMIX (wt %) | MIXTURE[1] (wt %) |
|---|---|---|
| Nonylphenol ethoxylate (EO = 9.5) | 81.11 | 35.0 |
| Hexylene glycol | 1.85 | 0.8 |
| Polyethylene glycol (MW 8000) (Union Carbide; CT) | 9.27 | 4.00 |
| Soft water | 6.95 | 3.00 |
| Direct blue 86 dye (Mobay; PA) | 0.01 | 0.004 |
| Whitener (Tinopal CBS-X) | 0.23 | 0.10 |
| Fragrance | 0.58 | 0.25 |

[1]Mixture containing liquid premix combined with the powdered premix.

The ingredients of the dry powder premix were as follows:

| INGREDIENT | POWDER PREMIX (wt %) | MIXTURE (wt %) |
|---|---|---|
| Sodium aluminosilicate (Zeolite 100) | 46.51 | 26.44 |
| Sodium metasilicate | 34.88 | 19.83 |
| Sodium carboxymethylcellulose | 2.33 | 1.32 |
| Sodium dodecylbenzene sulfonate (LAS 90%, flake) | 4.65 | 2.64 |
| Sodium polyacrylate (Goodrite K-7058 D) | 4.65 | 2.64 |
| Dense Ash (Na carbonate) | 6.98 | 3.97 |

The liquid premix was heated to 130° F. and pumped into the first liquid port of the Teledyne twin-screw mixer at a rate of 1.96 lbs to 2.28 lbs per minute. The powder premix was fed, using a weigh belt feeder, into the entrance of the Teledyne at a rate of 2.04 lbs to about 1.72 lbs per minute, depending on the desired amount of polyethylene glycol in the formula. The polyethylene glycol in the mixture can vary from 4.0% to 18.0% in the formula and the powder premix can vary from 43.0% to 57%. The product exited the machine at 105° F. The product formed a hard solid within 1 to 4 hours, depending on the level of PEG present.

EXAMPLE 2

Cleaning composition containing a nonionic surfactant cleaning agent and a polyethylene glycol hardening agent A detergent composition for use in textile care and laundering was prepared in the equipment described in Example 1.

The ingredients of the liquid premix were as follows:

| INGREDIENT | LIQUID PREMIX (wt %) | MIXTURE[1] (wt %) |
|---|---|---|
| Nonylphenol ethoxylate (EO = 9.5) | 36.82 | 20.20 |
| Nonylphenol ethoxylate (EO = 6.5) | 45.00 | 24.66 |
| Fatty alcohol ethyoxylate phosphate ester (PE362) (EO = 20) | 7.02 | 3.97 |
| Polyethylene glycol (MW 8000) (Union Carbide; CT) | 7.27 | 4.00 |
| Caustic soda 50% | 2.07 | 1.28 |
| Sulfonated triazinyl stilbene (Tinopal UNPA) | 0.18 | 0.10 |
| Soft water | 1.81 | 1.00 |
| Direct Blue 86 dye (Mobay; PA) | 0.01 | 0.004 |
| Silicone antifoam (Dow; MI) | 0.04 | 0.025 |

[1]Mixture containing liquid premix combined with the powdered premix.

The ingredients of the dry powder premix were as follows:

| INGREDIENT | POWDER PREMIX (wt %) | MIXTURE (wt %) |
|---|---|---|
| Anhydrous metasilicate, powdered | 41.81 | 18.71 |
| Sodium tripolyphosphate, powdered | 55.40 | 24.80 |
| Carboxymethyl cellulose, CMC 7LT | 2.79 | 1.25 |

The liquid premix was heated to 140° F. and pumped into the first liquid port of the Teledyne twin-screw mixer at a rate of 6.4 lbs per minute. The powder premix was fed, using a weigh belt feeder, into the entrance of the Teledyne at a rate of 3.6 lbs per minute. Cooling water was used in the mixer jacket at a rate of 2.5 gallons per minute. The product exited at 105° F. and was filled into polyethylene containers. The material hardened to a fused solid block. This product formulation had as high as 30% of the batches resulting in soft, separated product when manufactured in a traditional batch process. These disadvantages were essentially eliminated by using the method described herein to increase viscosity and lower operating temperatures.

EXAMPLE 3

Cleaning composition containing a nonionic surfactant cleaning agent builders and a polyethylene glycol hardening agent A cleaning composition to be used as a flatware presoak was prepared in the equipment described in Example 1.

The ingredients of the liquid premix were as follows:

| INGREDIENT | LIQUID PREMIX (wt %) | MIXTURE[1] (wt %) |
|---|---|---|
| Nonylphenol ethoxylate (EO = 9.5) | 56.25 | 18.00 |
| Sodium xylene sulfonate | 12.50 | 4.00 |
| Polyethylene glycol (MW 8000) (Union Carbide; CT) | 31.25 | 10.00 |

[1]Mixture containing liquid premix combined with the powdered premix.

The ingredients of the dry powder premix were as follows:

| INGREDIENT | POWDER PREMIX (wt %) | MIXTURE (wt %) |
|---|---|---|
| $C_{10}$–$C_{14}$ dimethylamine oxide | 2.94 | 2.00 |
| Sodium lauryl sulfate | 8.82 | 6.00 |
| Sodium metasilicate, anhy.,gran. | 7.35 | 5.00 |
| Sodium carbonate (dense ash) | 36.76 | 25.00 |
| Sodium tripolyphosphate, hydr. | 44.13 | 30.00 |

The liquid premix was heated to 165° F. and pumped into the first liquid port of the Teledyne mixer at a rate of 1.6 lbs per minute. The powder premix was fed, using a weigh belt feeder, into the entrance of the mixer at rates of about 3.4–4.4 lbs per minute. Product exited the machine at 123° F. and was filled into polyethylene containers. The material hardened to a fused solid block.

EXAMPLE 4

Cleaning composition containing a nonionic surfactant cleaning agent and a polyethylene glycol hardening agent A detergent composition for use in textile care and laundering was prepared in the equipment described in Example 1.

The ingredients of the liquid premix were as follows:

| INGREDIENT | LIQUID PREMIX (wt %) | MIXTURE[1] (wt %) |
|---|---|---|
| Nonylphenol ethoxylate (EO = 9.5) | 49.59 | 30.00 |
| $C_{12}$–$C_{15}$ fatty alcohol ethoxylate (EO = 7) | 42.98 | 26.00 |
| Polyethylene oxide (MW 8000) | 7.26 | 4.40 |
| Silicone antifoam (Dow; MI) | 0.17 | 0.10 |

[1]Mixture containing liquid premix combined with the powdered premix.

The ingredients of the dry powder premix were as follows:

| INGREDIENT | POWDER PREMIX (wt % | MIXTURE (wt %) |
|---|---|---|
| Sodium carbonate, dense ash | 25.32 | 10.00 |
| Tetrasodium pyrophosphate | 37.97 | 15.00 |
| Sodium metasilicate, anhyd., gran. | 30.38 | 12.00 |
| Sodium carboxymethylcellulose, CMC 7LT | 3.80 | 1.50 |
| Polyvinylpyrrolidone | 2.53 | 1.00 |

The liquid premix was heated to 150° F. and pumped into the first liquid port of the Teledyne mixer at 3.63 lbs per minute. The powder premix was fed, using a weigh belt feeder, into the entrance port of the Teledyne at 2.37 lbs per minute. The product exited the machine at 120° F. and was filled into polyethylene containers. The product hardened to a fused solid block in approximately 1 hour.

What is claimed is:

1. A homogeneous, non-caustic, solid block cleaning composition, produced by a process comprising the steps of:

(a) mixing in an extruder at high shear to provide a substantially homogeneous fluid mixture which contains an effective amount of a hardening agent selected from the group consisting of a mixture of a solid polyethylene glycol having a molecular weight of 3000 to 100,000 and anhydrous sodium carbonate; a sequestering agent selected from the group consisting of phosphates, phosphonates and mixtures thereof; and a cleaning agent comprising an alkali metal compound and 30 to 95 wt % of a nonionic surfactant, in a continuous mixing system below the melting temperature of the cleaning agent; and (b) removing shear from the mixture and continuously discharging the mixture from the system, causing the mixture to harden to a solid composition.

2. The composition of claim 1 wherein the cleaning agent is combined with about 0.01 to 15 wt-% of an aqueous medium.

3. The composition of claim 1 comprising about 0.1 to 10 wt-% of an aqueous medium.

4. The composition of claim 1 further comprising about 1 to 30 wt-% of a secondary alkaline source comprising a sodium carbonate or a sodium silicate.

5. The composition of claim 4 wherein the sodium silicate comprises sodium aluminosilicate, sodium metasilicate, or a mixture thereof.

6. The composition of claim 1 wherein the hardening agent is present in an amount of about 0.01 to 20 wt-%.

7. The composition of claim 1 wherein the mixing takes place at a temperature 1° to 90° C. below the melting point of the cleaning agent.

8. The composition of claim 1 wherein the mixture is discharged by casting into a packaging system.

9. The composition of claim 1 wherein the cleaning agent is a nonionic surfactant comprising a polyalkylene oxide polymer selected from the group consisting of alcohol alkoxylates, polyethylene glycol ethers of fatty alcohols, carboxylic acid esters, carboxylic amides, polyalkylene oxide block copolymers, and mixtures there of.

10. The composition of claim 1 wherein the cleaning agent comprises nonylphenol ethoxylate.

11. A method of preparing a homogeneous, non-caustic, solid block cleaning composition comprising the steps of:

(a) mixing in an extruder at high shear to provide a substantially homogeneous fluid mixture which contains an effective amount of a hardening agent selected from the group consisting of a mixture of a solid polyethylene glycol having a molecular weight of 3000 to 100,000 and anhydrous sodium carbonate; a sequestering agent selected from the group consisting of phosphates, phosphonates and mixtures thereof; and a cleaning agent comprising an alkali metal compound and 30 to 95 wt % of a nonionic surfactant, in a continuous mixing system below the melting temperature of the cleaning agent; and (b) removing shear from the mixture and continuously discharging the mixture from the system, causing the mixture to harden to a solid composition.

12. The method of claim 11 wherein the cleaning agent is combined with about 0.01 to 15 wt-% of an aqueous medium.

13. The method of claim 11 comprising about 0.1 to 10 wt-% of an aqueous medium.

14. The method of claim 11 further comprising about 1 to 30 wt-% of a secondary alkaline source comprising a sodium carbonate or a sodium silicate.

15. The composition of claim 14 wherein the sodium silicate comprises sodium aluminosilicate, sodium metasilicate, or a mixture thereof.

16. The method of claim 11 wherein the hardening agent is present in an amount of about 0.01 to 20 wt-%.

17. The method of claim 11 wherein the mixing takes place at a temperature 1° to 90° C. below the melting point of the cleaning agent.

18. The method of claim 11 wherein the mixture is discharged by casting into a packaging system.

19. The method of claim 11 wherein the cleaning agent is a nonionic surfactant comprising a polyalkylene oxide polymer selected from the group consisting of alcohol alkoxylates, polyethylene glycol ethers of fatty alcohols, carboxylic acid esters, carboxylic amides, polyalkylene oxide block copolymers, and mixtures thereof.

20. The method of claim 11 wherein the cleaning agent comprises nonylphenol ethoxylate.

* * * * *